US011473261B2

(12) United States Patent
Oltmann

(10) Patent No.: US 11,473,261 B2
(45) Date of Patent: Oct. 18, 2022

(54) OFFSHORE PLATFORM WITH AT LEAST ONE PILE

(71) Applicant: Tractebel Overdick GmbH, Hamburg (DE)

(72) Inventor: Klaas Oltmann, Seevetal (DE)

(73) Assignee: Tractebel Overdick GmbH, Hamburg (DE)

( * ) Notice: Subject to any disclaimer, the term of this patent is extended or adjusted under 35 U.S.C. 154(b) by 0 days.

(21) Appl. No.: 16/285,663

(22) Filed: Feb. 26, 2019

(65) Prior Publication Data

US 2019/0264416 A1 Aug. 29, 2019

(30) Foreign Application Priority Data

Feb. 26, 2018 (DE) ..... 10 2018 104 328.7

(51) Int. Cl.

| | |
|---|---|
| ***E02D 27/52*** | (2006.01) |
| ***E02B 17/02*** | (2006.01) |
| ***E02D 27/12*** | (2006.01) |
| ***E02D 27/42*** | (2006.01) |
| *E02B 17/00* | (2006.01) |

(52) U.S. Cl.

CPC ..... *E02D 27/52* (2013.01); *E02B 17/02* (2013.01); *E02B 17/027* (2013.01); *E02D 27/12* (2013.01); *E02D 27/42* (2013.01); *E02B 2017/0039* (2013.01); *E02B 2017/0043* (2013.01); *E02B 2017/0047* (2013.01); *E02B 2017/0095* (2013.01); *E02D 27/525* (2013.01)

(58) Field of Classification Search

CPC ..... E02B 2017/0043; E02B 17/02; E02B 17/027; E02B 2017/0039; E02B 2017/0047; E02B 17/00; E02B 2017/0095; E02D 27/42; E02D 27/525; E02D 27/12; E02D 27/52

See application file for complete search history.

(56) References Cited

U.S. PATENT DOCUMENTS

| | | | | |
|---|---|---|---|---|
| 4,245,928 A * | 1/1981 | Nei | E02D 29/06 405/195.1 |
| 4,527,928 A * | 7/1985 | Rutherford | E02B 17/0017 405/195.1 |
| 2012/0177447 A1* | 7/2012 | Fraenkel | E02D 5/285 405/232 |
| 2015/0125220 A1* | 5/2015 | Glukhovskoy | E02D 27/12 405/227 |

FOREIGN PATENT DOCUMENTS

| | | |
|---|---|---|
| CN | 106 013 212 A | 10/2016 |
| DE | 20 2007 009 474 U1 | 11/2008 |
| DE | 10 2016 116 167 A1 | 3/2018 |

(Continued)

*Primary Examiner* — Carib A Oquendo

(74) *Attorney, Agent, or Firm* — Bay State IP, LLC

(57) ABSTRACT

An offshore platform with at least one pile of a pile foundation with an outer wall having an external diameter and with a tube (8, 12) with an inner wall having an internal diameter which is greater than the external diameter, on the exterior of which attachments are arranged, and which is slid over the pile (2, 3) driven into the seabed (4), wherein at least one spacer (20) is provided between the outer wall of the pile (2, 3) and the inner wall of the tube (8, 12).

11 Claims, 4 Drawing Sheets

(56) References Cited

FOREIGN PATENT DOCUMENTS

| | | | | | |
|---|---|---|---|---|---|
| DE | 102016116167 | A1 | * | 3/2018 | ..... E02B 17/0004 |
| GB | 2 006 910 | A | | 5/1979 | |
| JP | 2011-226 111 | A | | 11/2011 | |
| WO | 2011/033267 | A2 | | 3/2011 | |
| WO | WO 2011/033267 | | * | 3/2011 | |

* cited by examiner

OFFSHORE PLATFORM WITH AT LEAST ONE PILE

CROSS REFERENCE TO RELATED APPLICATION

This application claims priority to and takes the benefit of German Patent Application No. 10 2018 104 328.7 filed on Feb. 26, 2018, the contents of which are herein incorporated by reference.

BACKGROUND OF THE INVENTION

Field of the Invention

The invention relates to an offshore platform with at least one pile of a pile foundation with an outer wall with an external diameter and a method for installation of an offshore platform.

Description of the Related Art

Naturally, offshore platforms are well known in the prior art. In particular in the construction of wind farms, so-called transmission stations are required which have current feed and discharge lines, to which the current generated by the wind turbines is supplied, is transformed there and is conducted to land via an undersea cable. The power lines must be run from the platform superstructure, also referred to as "topsides", to the seabed. Cable guides are intended for this. It is also necessary to enable the transport from topsides to the surface of the sea for the supply and discharge of fresh water, the transport of people by ladders, etc. The problem is that the transmission platforms usually stand on driven piles. The piles are driven into the seabed by means of a hammer. In this case enormous acceleration forces are exerted on the driven pile. Attachments to the driven piles are almost impossible. They would fall away during driving. Nevertheless, as described above, it is absolutely necessary to fasten attachments to the pile foundation of the transmission platform.

SUMMARY OF THE INVENTION

The object of the invention is to provide an offshore platform in which the attachments to driven piles are made available and also to provide a method by which the attachments to driven piles are facilitated.

In a first aspect this object is achieved by an offshore platform referred to in the introduction.

The invention makes use of the idea of sliding a tube onto a driven pile with an outer wall which preferably has a constant external diameter along its entire length, said tube having an inner wall with an internal diameter which is preferably likewise constant over its entire longitudinal extent and is somewhat greater than the external diameter of the driven pile.

The tube can be slid by means of a crane onto the pile which is driven into the seabed. In this way it is possible first of all to drive the pile with a hammer and with considerable temporary accelerations into the seabed and, after the driven pile has reached its ultimate position in the seabed, then to slip the tube with attachments over the pile. The tube is preferably connected to a support piece which is placed onto an upper end of the pile which is driven into the seabed. The support piece is closed in the horizontal plane or has an internal diameter which is smaller than the external diameter of the pile, so that the support piece does not slide downwards on the pile but rests thereon.

The tube can be connected to the support piece by means of a linkage. It is also conceivable that in the longitudinal direction of the pile the tube has a considerable longitudinal extent, so that the support piece is directly connected integrally, preferably welded, to the tube in a fixed position at the end of the tube remote from the seabed.

At least one spacer which keeps the tube fixed relative to the pile in operation is provided in a gap between the outer wall of the pile and the inner wall of the tube. This can be a resilient spacer or concrete or the like cast into the gap via openings in the pile.

Attachments, for example mountings, in particular for a cable guide, as well as the cable guide itself, are preferably arranged externally on the tube. Mountings for pipelines, mountings for landing stations for boats including the landing station itself can also be provided. Fastening devices for gangways and gangways themselves can be arranged externally on the tubes. Since the tubes can be slid carefully over the piles by a crane, no strong forces act on the attachments on the tube during the assembly of the tube, so that the attachments can have a costly and complex construction.

A guide is advantageously provided at the end of the tube, preferably of each of the tubes, nearest to the seabed. This can be a funnel which widens towards the seabed and facilitates the fitting of the tube onto the pile.

The fitted tube can extend over the entire length of the portion of the driven pile projecting above the seabed. This means that the tube is placed almost on the seabed, possibly is even placed on the seabed, but preferably ends with a spacing just above the seabed, wherein this spacing can be 1, 2 or 3 m. However, all intermediate spacings are also disclosed hereby.

The tube is preferably provided with openings in the longitudinal direction, that is to say vertically, and the tube is preferably not formed as a pipe, but is even formed as a linkage which only has a narrow tube at the end nearest to the seabed and has a support piece at the end remote from the seabed.

In its second aspect, the object is achieved by a method with the features of at least one pile (2, 3) of a pile foundation with an outer wall having an external diameter is driven into the seabed (4); a tube (8, 12) with an inner wall having an internal diameter which is greater than the external diameter is slid over a free end of the pile (2, 3) remote from the seabed, and attachments (17, 19) are fastened to the exterior of the tube (8, 12), characterised in that at least one spacer (20) is provided between the outer wall of the pile (2, 3) and the inner wall of the tube (8, 12).

According to the invention at least one pile is driven into the seabed. After the pile has been driven completely into the seabed to an intended depth, a tube according to the invention is placed over an end of the pile remote from the seabed. Attachments are fastened externally on the tube. At least one spacer is provided between the outer wall of the pile and the inner wall of the tube.

First of all the method according to the invention is suitable to be carried out with one of the above-mentioned offshore platforms; conversely, each of the above-mentioned offshore platforms is suitable for installation by this method or one of the methods referred to below.

Reference is made to the above statements with regard to the attachments, which can be in particular cable guides or the mountings therefor, water pipes, in particular fresh water pipes or mountings therefor, retaining devices for landing stations as well as ladder for transfer of people.

The tube is preferably pulled some way over the pile in the direction of the seabed.

In particular the tube can be pulled over the pile to the height of sea level or even deeper, so that attachments can be fastened to the tube at the height of sea level or also even between the seabed and sea level. For example, cable guides are arranged which extend from the platform superstructure to just above the seabed, so that the cables guided in them can be arranged so that they are protected between the seabed and the platform superstructure.

In a preferred embodiment the tube is connected to a fitting which is arranged on the tube remote from the seabed. The fitting can be connected to the tube by means of a linkage. It is also conceivable that the tube has a sufficient length, so that the fitting is connected to the tube in a fixed position at the end of the tube remote from the seabed. When the tube is placed onto the pile, the fitting is placed at the top onto the free end of the pile and prevents further slipping of the tube towards the seabed.

Particularly preferably a gap between the tube and the pile is sealed. The slot can be filled completely or only at specific points. In this way the position of the tube relative to the pile is kept stable, and also in the event of breaking of waves the tube will not knock against the pile.

Particularly preferably, various tubes which are slid over various piles are connected to one another by a linkage. Further attachments can also be arranged on the linkage.

BRIEF DESCRIPTION OF THE DRAWINGS

The invention is described with reference to an embodiment with five drawings. In the drawings.

DETAILED DESCRIPTION OF THE SEVERAL EMBODIMENTS

Figure 1:
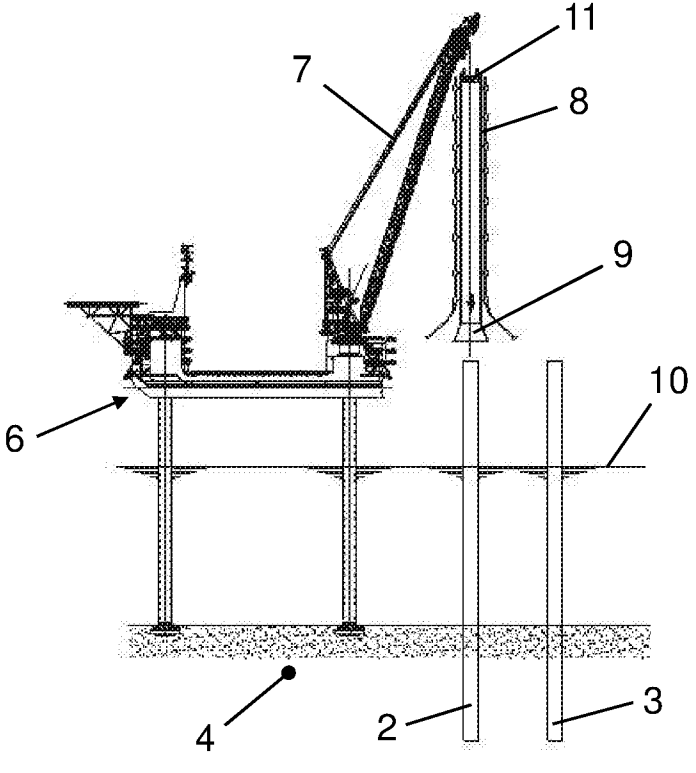
FIG. 1 shows a schematic side view of two driven piles, wherein a tube according to the invention is slid over one of them.

FIG. 1 shows a foundation of a transmission platform 1, in which a first pile 2 and a second pile 3 are driven into a seabed 4. A crane 7 arranged on a lifting platform 6 and a hammer (no shown) arranged on the crane 7 are used for driving the piles 2, 3 into the seabed 4. The two piles 2, 3 are driven into the seabed 4 to the same height, i.e. they each project by a portion of the same length above the surface of the water 10.

FIG. 1 shows a first method step in which a first tube 8 according to the invention is placed over the first pile 2. The first tube 8 is raised by means of the crane 7 and kept vertical. The first tube 8 has at its end nearest to the seabed end a guide 9 in the form of a funnel which is open towards the bottom, which simplifies the sliding of the first tube 8 over the first pile 2. Two cable guides 19 are arranged laterally opposite one another on the first tube 8. The first tube 8 has a length which substantially corresponds to the length of the portion of the first pile 2 above the seabed 4.

Figure 2:
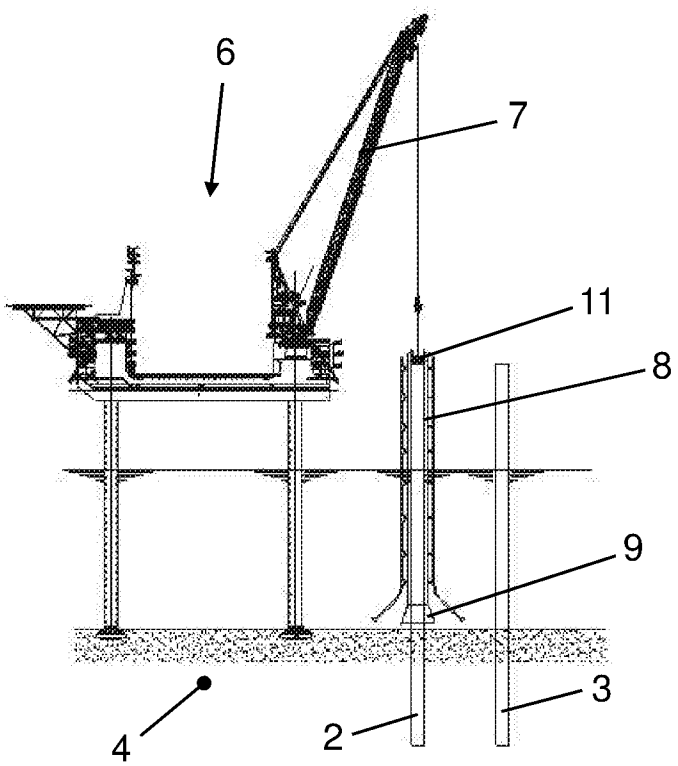
FIG. 2 shows a tube slid onto the pile in FIG. 1.

FIG. 2 shows the first tube 8 slid completely over the first pile 2. The guide 9 is spaced just above the seabed 4. The spacing is approximately 1 m, preferably 2 m. All intermediate values are also disclosed hereby.

A first support piece 11, which is connected in a fixed position to the first tube 8 and facilitates placement of the first tube 8 onto the first pile 2, is arranged at the end of the first tube 8 remote from the seabed. Slipping of the first tube 8 is prevented by the first support piece 11.

Figure 3:
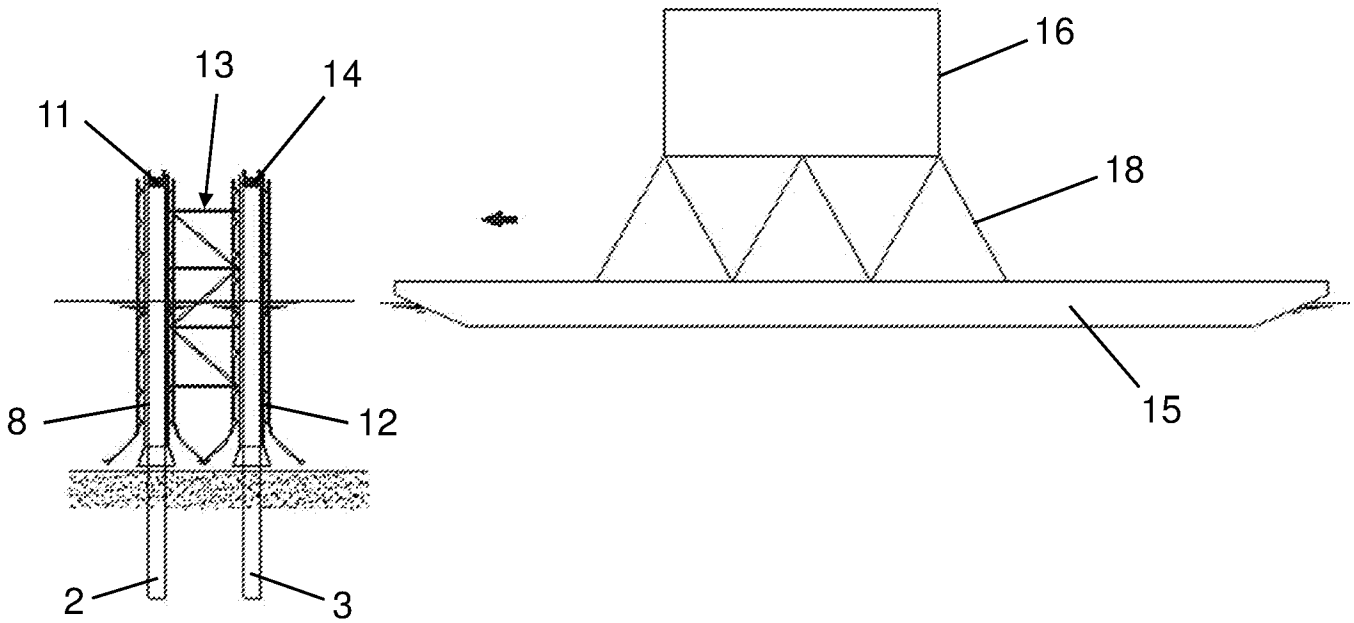
FIG. 3 shows tubes slid onto two driven piles of the pile foundation and a pontoon with a topsides.

FIG. 3 shows a third method step in which a second tube 12 is already placed over the second pile 3, and a linkage 13 which connects the two tubes 8, 12 to one another in a fixed position is arranged between the two adjacent tubes 8, 12.

The first tube 8 is fitted on the first pile 2 by means of the first support piece 11, and the second tube 12 is fitted on the second pile 3 by means of the second support piece 14.

For final assembly of the transmission platform 1 a topsides, that is to say a platform superstructure 16, is shipped in one piece to its location by means of a pontoon 15. The platform superstructure 16 is arranged on a framework 18 on the pontoon 15. The pontoon 15 can be lowered by flooding of water tanks and can be raised by blowing out of the water tanks. The framework 18 has any height so that when the water tanks are filled with air the platform superstructure 16 can be arranged over upper ends of the driven piles 2, 3 above the support pieces 11, 14. This stage of the method is illustrated in FIG. 4.

Figure 4:
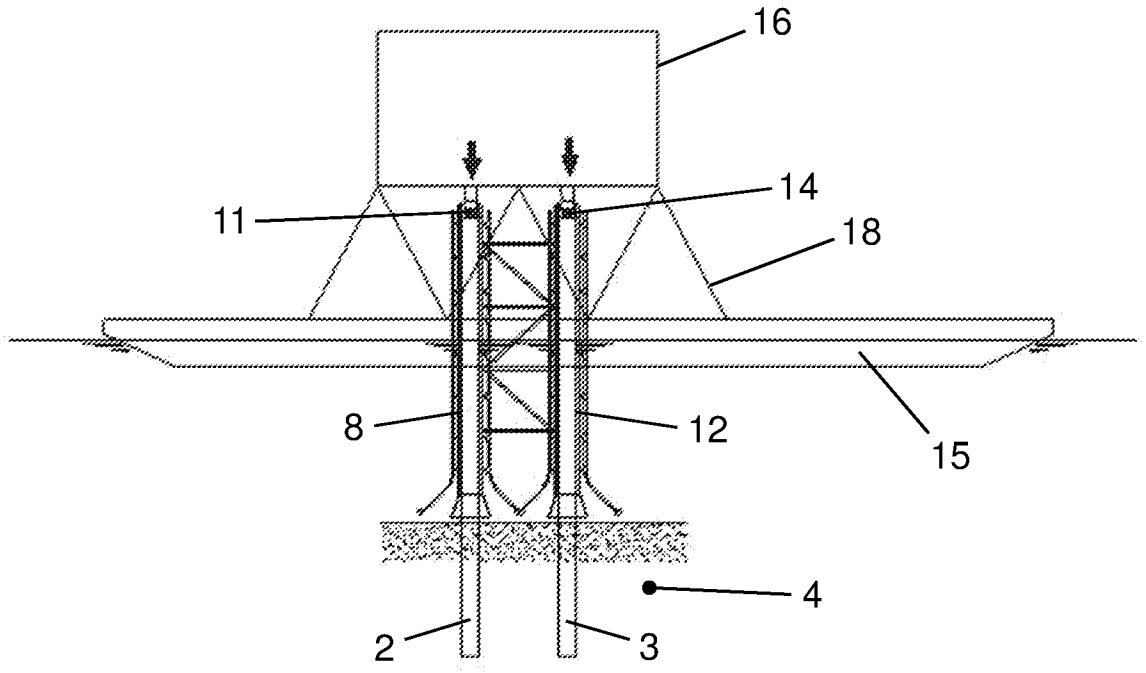
FIG. 4 shows a pontoon with the topsides which has been positioned between the driven piles and has just been placed onto the ends of the piles.

According to FIG. 4 the platform superstructure 16 is moved over the upper ends of the piles 2, 3 remote from the seabed and also above the support pieces 11, 14 of the associated tubes 8, 12, and the pontoon 15 has a width such that it can be slid through between adjacent piles. In FIGS. 1, 2, 3 and 4 the transmission platform 1 has at least three, preferably four or six of the piles 2, 3. The drawings illustrate the first and the second piles 2, 3, and the other piles are arranged concealed by the first and the second piles 2, 3 in the drawings.

Due to flooding of the water tanks of the pontoon 15 the platform superstructure 16 is lowered and is then located on the piles 2, 3. Finally it can then be permanently fastened there.

Figure 5:
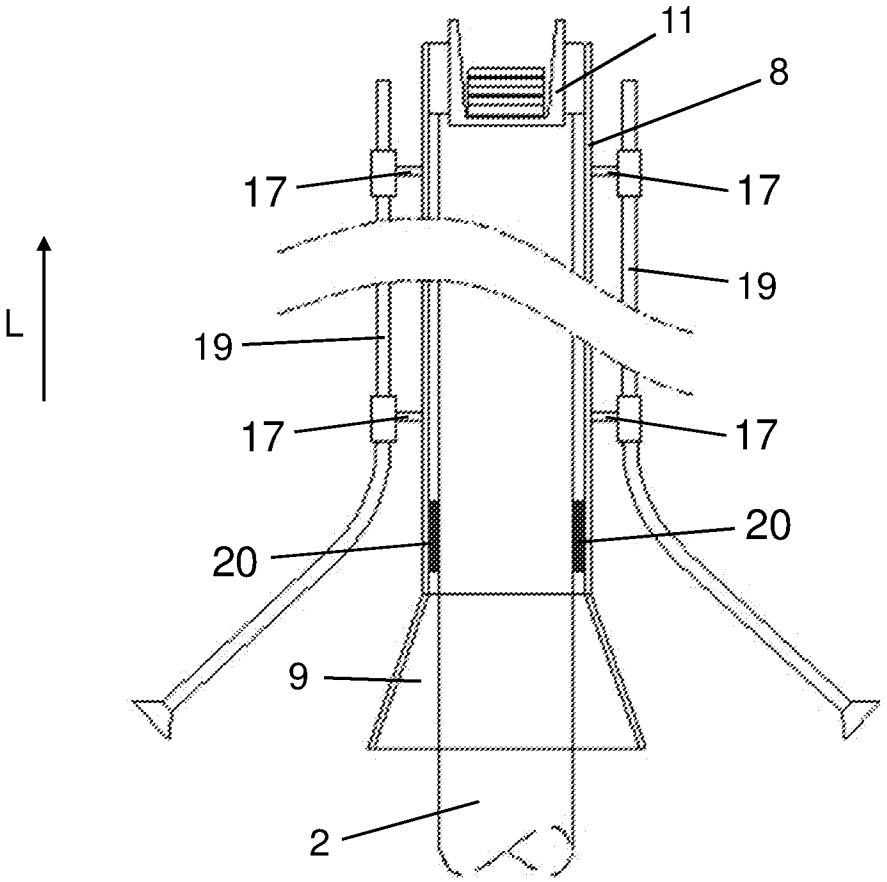
FIG. 5 shows a longitudinal sectional view of the tube according to the invention.

FIG. 5 shows a detail of an end of the first tube 8 nearest to the seabed and an end remote from the seabed. The first tube 8 has, at its end nearest to the seabed, the guide 9 which is formed in one piece with the first tube 8 and widens towards the seabed 4 in the form of a funnel at the end of the first tube 8 nearest the seabed. The guide 9 facilitates the sliding of the first tube 8 by means of the crane 7 over the free upper end of the first pile 2 according to FIG. 1.

At least one spacer 20 is provided between the outer wall of the first pile 2 and the inner wall of the first tube 8. The spacers 20 can be individual, preferably resilient components or a circumferential ring. The spacer 20 can also be formed as filling material, such as concrete, poured into the gap.

The first support piece 11 for the platform superstructure 16 is provided at the end remote from the seabed. The first support piece 11 is connected in a fixed position to the first tube 8. The first support piece 11 can be an LMU or a transition piece. Mountings 17, which each have a sleeve through which a respective one of the cable guides 19 is guided on both sides, are arranged spaced apart from one another in the longitudinal direction L on the side of the first tube 8. After the erection of the transmission platform 1, various power cables can be passed through the cable guides 19. However, other attachments such as water pipes, landing stations for boats, ladders for the transfer of people, gangways etc. on the first tube 8 are also conceivable.

What is claimed is:

1. An offshore platform comprising: at least three piles of a pile foundation, wherein the piles include an outer wall having an external diameter each and the pile foundation includes at least two tubes (8, 12) with an inner wall having an internal diameter each which is greater than the external diameter of the at least three piles, attachments are arranged on an exterior of the at least two tubes attachments are arranged, and wherein the piles have been driven into a seabed and the at least two tubes are slid over at least two of the three piles (2, 3), characterised in that at least one spacer (20) is provided between the outer wall of the piles (2, 3) and the inner wall of the at least two tubes (8, 12) and in that the attachments (17, 19) have at least one cable guide (19) and a linkage (13) which connects the at least two tubes (8, 12) to one another in a fixed position and that a support piece (11, 14) is directly connected to one of the tubes (8, 12) at an end of the tube (8, 11) remote from the seabed.

2. The offshore platform according to claim 1, characterised in that the at least two tubes (8, 12) are connected to the support piece (11, 14) which is placed onto an upper end of the pile (2, 3).

3. The offshore platform according to claim 1, characterised in that the tube (8, 12) has openings in a longitudinal direction (L).

4. The offshore platform according to claim 1, characterised in that different tubes (8, 12) are connected to one another by means of the linkage (13) and have a spacing from one another which corresponds to the spacing of different piles (2, 3) over which they are slid.

5. The offshore platform according to claim 1, characterised in that a guide device is arranged on the end of the tube (8, 12) nearest to the seabed.

6. The offshore platform according to claim 1, characterised in that the tube (8, 12) which is slid on extends over the entire length of the portion of the driven pile projecting above the seabed (4).

7. A method for the installation of an offshore platform, wherein the offshore platform comprises at least two piles (2, 3) of a pile foundation, wherein the piles include outer walls having external diameters and wherein the piles are driven into a seabed (4); at least two tubes (8, 12) with inner walls having internal diameters which is greater than the external diameters of the piles, the at least two tubes are slid over free ends of the at least two piles (2, 3) remote from the seabed, and attachments (17, 19) are fastened to an exterior of the tubes (8, 12), characterised in that at least one spacer (20) is provided between the outer wall of the piles (2, 3) and the inner wall of the tubes (8, 12) and in that at least one cable guide (19) is attached on the exterior of the tubes (8, 12) and cables are guided through the cable guide (19) and the tubes (8, 12) are connected to one another in a fixed position by a linkage (13) and that a support piece (11, 14) is directly connected to one of the tubes (8, 12) at an end of the tube (8, 11) remote from the seabed.

8. The method according to claim 7, characterised in that the tube (8, 12) is pulled at least some way over the pile (2, 3) in the direction of the seabed (4).

9. The method according to claim 7, characterised in that the tube (8, 12) is connected to a fitting which is put in place after the tube (8, 12) is slid over the free end of the driven pile (2, 3).

10. The method according to claim 7, characterised in that a gap between the tube (8, 12) and the pile (2, 3) is sealed.

11. The method according to claim 7, characterised in that different tubes (8, 12) of different piles (2, 3) are connected to one another by the linkage (13).

* * * * *